US010453640B2

(12) United States Patent
Ohashi et al.

(10) Patent No.: US 10,453,640 B2
(45) Date of Patent: Oct. 22, 2019

(54) FUSE UNIT

(71) Applicant: Yazaki Corporation, Minato-ku, Tokyo (JP)

(72) Inventors: Norihiro Ohashi, Makinohara (JP); Masayoshi Ozawa, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/670,245

(22) Filed: Aug. 7, 2017

(65) Prior Publication Data

US 2018/0047538 A1 Feb. 15, 2018

(30) Foreign Application Priority Data

Aug. 12, 2016 (JP) ..... 2016-158823

(51) Int. Cl.

| | |
|---|---|
| ***H01H 85/00*** | (2006.01) |
| ***H01H 85/02*** | (2006.01) |
| ***H01H 85/044*** | (2006.01) |
| ***H01H 85/175*** | (2006.01) |
| ***H01H 85/20*** | (2006.01) |

(52) U.S. Cl.

CPC .... *H01H 85/0026* (2013.01); *H01H 85/0241* (2013.01); *H01H 85/044* (2013.01); *H01H 85/175* (2013.01); *H01H 85/20* (2013.01); *H01H 85/2045* (2013.01); *H01H 2085/025* (2013.01)

(58) Field of Classification Search

CPC ..... H01H 85/0026; H01H 85/003; H01H 85/0241; H01H 85/025; H01H 85/175; H01H 85/20; H01H 85/2045; H01H 2085/025; H01H 85/044

USPC ..... 337/186

See application file for complete search history.

(56) References Cited

U.S. PATENT DOCUMENTS

| | | | | |
|---|---|---|---|---|
| 9,490,095 | B2 | 11/2016 | Matsumoto | |
| 2002/0134572 | A1* | 9/2002 | Matsumura | H01H 85/044 174/66 |
| 2007/0241857 | A1* | 10/2007 | Ito | H01H 85/045 337/187 |

(Continued)

FOREIGN PATENT DOCUMENTS

| | | | |
|---|---|---|---|
| JP | 2010-021055 | A | 1/2010 |
| JP | 2011-146135 | A | 7/2011 |

OTHER PUBLICATIONS

Aug. 28, 2018—(JP) Notification of Reasons for Refusal—App 2016-158823.

*Primary Examiner* — Jacob R Crum

(74) *Attorney, Agent, or Firm* — Banner & Witcoff, Ltd.

(57) ABSTRACT

A fuse unit includes a fuse element which includes a fusible portion, a housing which accommodates the fuse element in a state that the fusible portion is exposed to an outside thereof, and a cover which is attached to the housing so as to cover the fusible portion. The cover includes a pair of side wall portions which is disposed so as to face each other with the fusible portion interposed therebetween, and a connection portion which connects the pair of side wall portions. The housing includes a guide wall which is configured to guide the cover toward the fusible portion when the cover is attached to the housing. The guide wall is inclined to a direction intersecting a separation direction in which the cover is separated from the housing.

5 Claims, 6 Drawing Sheets

(56) References Cited

U.S. PATENT DOCUMENTS

| | | | | |
|---|---|---|---|---|
| 2009/0061291 | A1* | 3/2009 | Ohashi | B60R 16/04 429/65 |
| 2009/0108981 | A1* | 4/2009 | Iwata | G01R 1/0408 337/186 |
| 2012/0262267 | A1* | 10/2012 | Nohara | H01H 85/044 337/186 |
| 2012/0286922 | A1* | 11/2012 | Matsumoto | H01H 85/0078 337/206 |
| 2015/0130584 | A1* | 5/2015 | Totsuka | H01H 85/12 337/186 |

* cited by examiner

FUSE UNIT

CROSS REFERENCE TO RELATED APPLICATIONS

This application is based on Japanese Patent Application (No. 2016-158823) filed on Aug. 12, 2016, the contents of which are incorporated herein by way of reference.

BACKGROUND

The present invention relates to a fuse unit which includes a fuse element having a fusible portion, a housing which accommodates the fuse element in a state where the fusible portion is exposed to an outside thereof, and a cover which is attached to the housing so as to cover the fusible portion.

In the related art, a fuse unit that is directly attached to a battery for a vehicle or the like has been proposed.

For example, in one of the fuse units of the related art (hereinafter referred to as "unit of the related art"), a U-shaped cover (cover having a pair of side wall portions and connection portion which connects side wall portions to each other) is mounted on the housing so as to cover the fusible portion of the fuse element (fusing portion) exposed from the housing. Scattering of a fused matter (molten piece of metal forming the fusible portion) is prevented when the fusible portion is fused by the cover described above being mounted on the housing (see, for example, Patent Document 1).

[Patent Document 1] JP 2010-021055 A

SUMMARY

The present invention has been made in view of the above circumstances, and an object of the present invention is to provide a fuse unit in which a cover can be easily attached to a housing and unintentional falling off of the cover can be suppressed.

In order to achieve the object described above, a fuse unit according to the present invention is described by the following (i) and (ii).

(i) A fuse unit including:

a fuse element which includes a fusible portion;

a housing which accommodates the fuse element in a state that the fusible portion is exposed to an outside thereof; and a cover which is attached to the housing so as to cover the fusible portion, wherein the cover includes a pair of side wall portions which is disposed so as to face each other with the fusible portion interposed therebetween, and a connection portion which connects the pair of side wall portions, the housing includes a guide wall which is configured to guide the cover toward the fusible portion when the cover is attached to the housing, and the guide wall is inclined to a direction intersecting a separation direction in which the cover is separated from the housing.

(ii) The fuse unit according to the above (i), wherein the housing includes an abutment portion which protrudes at a termination end portion of the guide wall in the separation direction, and the fusible portion is interposed between the pair of side wall portions of the cover in a state that the cover and the abutment portion abut against each other.

BRIEF DESCRIPTION OF DRAWINGS

FIG. 4A is a cross-sectional view illustrating a stage in which the cover is close to a guide wall, and FIG. 4B is a cross sectional view illustrating a stage in which the cover is guided along the guide wall.

DETAILED DESCRIPTION OF EXEMPLIFIED EMBODIMENT

In the unit of the related art, when the cover is mounted on the housing, if the cover is pushed into the housing in a state where the positioning of the cover is insufficient, deformation or the like may occur in the cover. Furthermore, when it is necessary to attach the cover in the longitudinal direction (vertical direction) to the housing depending on the shape of the fuse element or the like, when the cover is incompletely locked or the like, there is a fear that positional deviation (unintentional falling off in a case where excessive positional deviation is generated) of the cover is generated due to gravity.

The present invention has been made in view of the above circumstances, and an object of the present invention is to provide a fuse unit in which a cover can be easily attached to a housing and unintentional falling off of the cover can be suppressed.

Hereinafter, a fuse unit 10 according to an embodiment of the present invention will be described with reference to the drawings.

Figure 1:
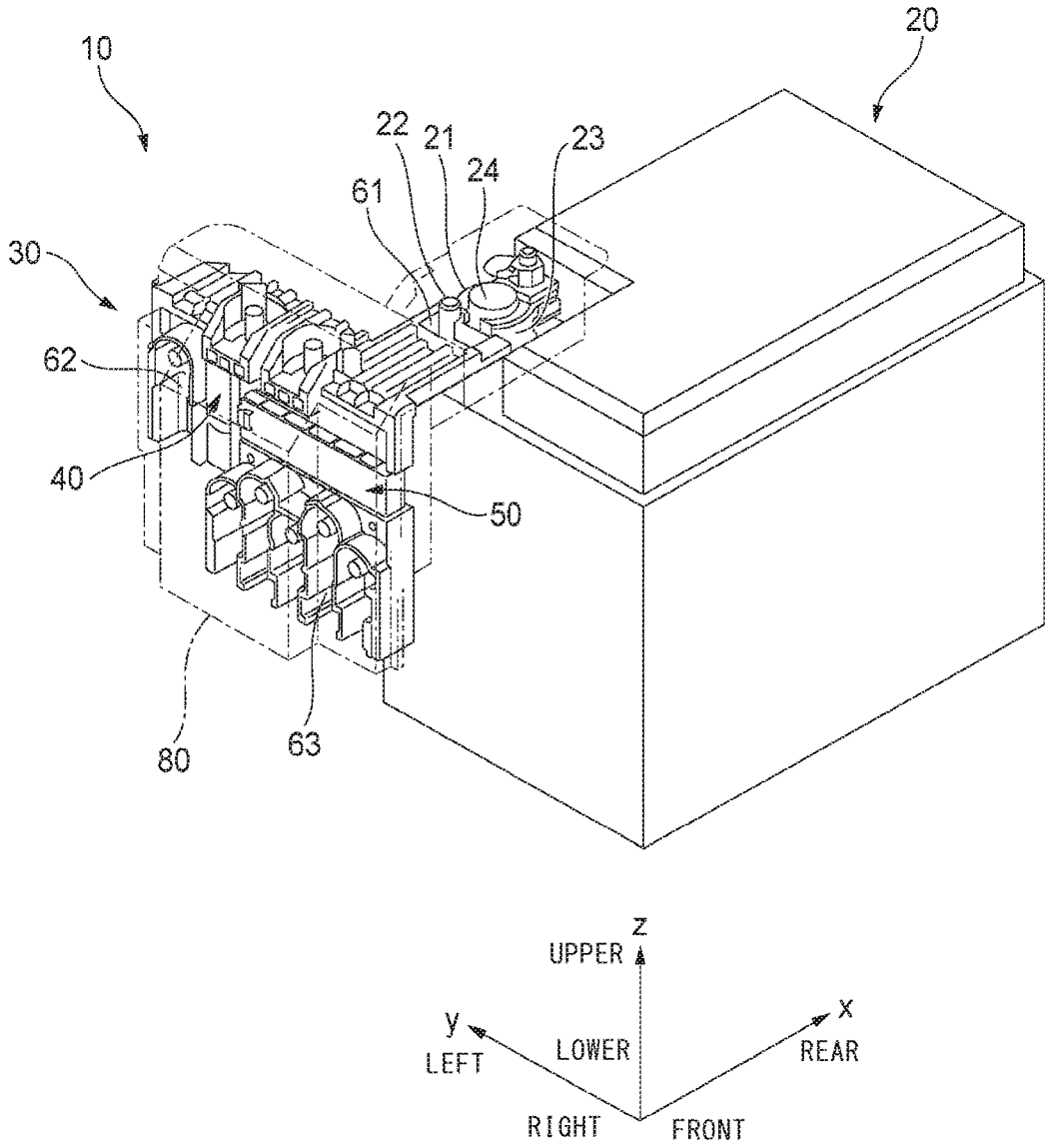
FIG. 1 is a perspective view illustrating a fuse unit according to the present embodiment in a state of being directly attached to a battery for a vehicle.

As illustrated in FIG. 1, the fuse unit 10 has a function that electrically connects a battery 20 and an electric wire (not illustrated) extending from an external load (not illustrated) to each other and cuts off the electrical connection between the battery 20 and the electric wire when the electric current exceeding the rating flows in the electric wire.

The fuse unit 10 includes a unit main body 30 and covers 40 and 50 which are attached to the unit main body 30 (more specifically, housing 70 to be described below). Hereinafter, for convenience of explanation, as illustrated in FIG. 1, an x-axis, a y-axis, and a z-axis orthogonal to each other are defined.

In addition, an x-axis direction, a y-axis direction, and a z-axis direction are referred to as a front-rear direction, a width direction, and a vertical direction, respectively. An x-axis negative direction side and an x-axis positive direction side correspond to a front side and a rear side, respectively, a y-axis positive direction side and a y-axis negative direction side correspond to a left side and a right side, respectively, and a z-axis positive direction side and a z-axis negative side correspond to an upper side and a lower side, respectively.

Figure 2:
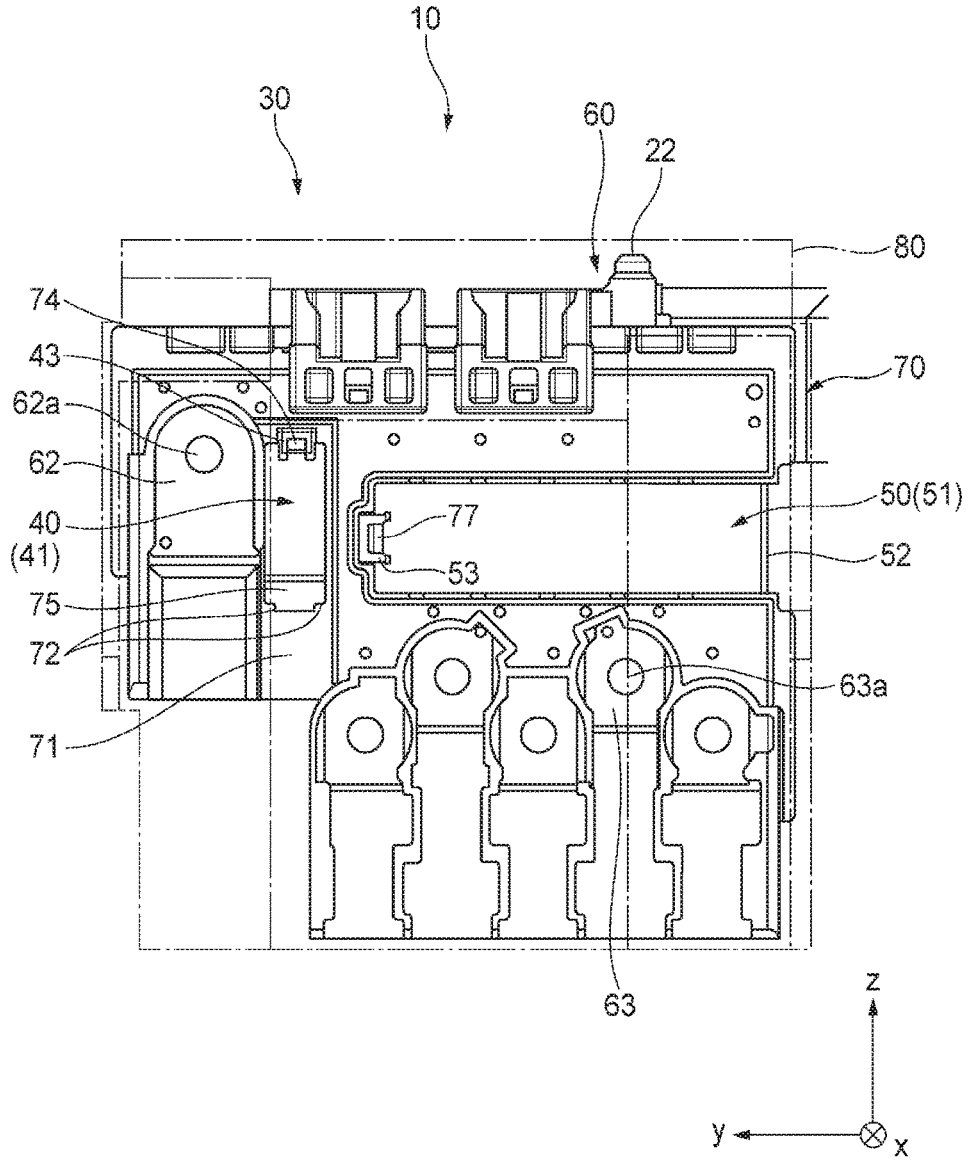
FIG. 2 is a front view of the fuse unit illustrated in FIG. 1.

As illustrated in FIG. 2, the unit main body 30 includes a metallic electrical connection portion 60 and a resin housing 70. The electrical connection portion 60 is mainly configured by a bus bar (plate-like metal member). The housing 70 is formed (Molded) of integrally with the electrical connection portion 60 by a resin material so as to cover (accommodate) the majority of the electrical connection portion 60.

The electrical connection portion 60 includes a battery connection portion 61, a first electric wire connection portion 62, a plurality (five in the present example) of second electric wire connection portions 63, a first fuse element 64, and a plurality of (five in the present example) second fuse elements 65 as portions which expose from the housing 70.

As illustrated in FIG. 1, the battery connection portion 61 is a plate-like portion which extends from the right upper portion of the unit main body 30 to the rear side and electrically connected to the battery 20 via the relay terminal 21. A stud bolt 22 provided at the relay terminal 21 is inserted into a through hole (not illustrated) formed at a tip portion (rear end portion) of the battery connection portion 61 and the stud bolt 22 and the battery connection portion 61 are fastened and fixed to each other by a bolt (not illustrated). Furthermore, a fastening portion 23 provided on the relay terminal 21 is attached so as to interpose a columnar electrode (battery post 24) disposed on an upper surface of the battery 20 and the fastening portion 23 is fastened and fixed to the battery post 24 by a fastening mechanism using a bolt. Accordingly, the battery connection portion 61 is fixed in a state of being electrically connected to the battery post 24 (accordingly, the battery 20).

Figure 3:
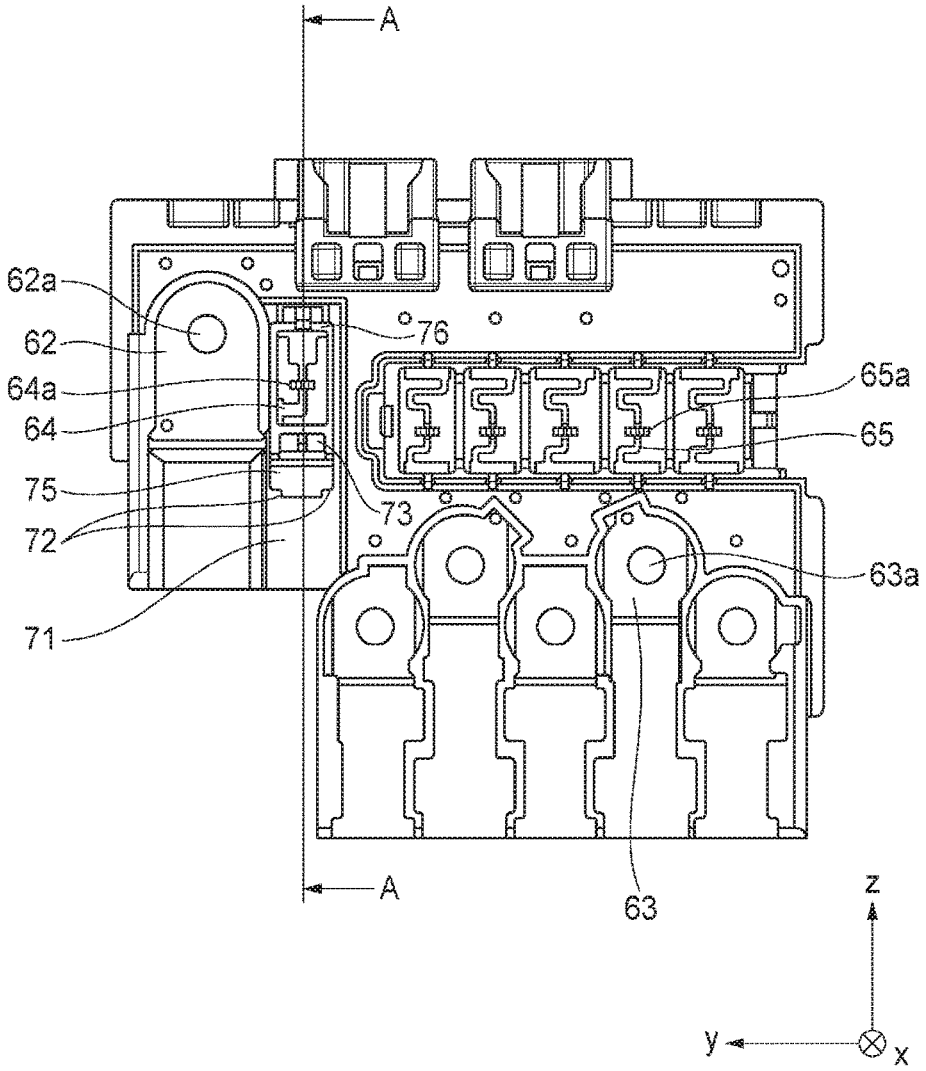
FIG. 3 is a view corresponding to FIG. 2 in a state where a cover is removed and a fuse element is exposed.

As illustrated in FIG. 2 and FIG. 3, the first electric wire connection portion 62 is a portion that is exposed forward at the left upper portion on the front side surface of the unit main body 30 and is electrically connected to the first electric wire (not illustrated). An example the first electric wire includes an electric wire connected to a power supply system component such as an alternator. The stud bolt 62*a* is disposed on the first electric wire connection portion 62. The through hole provided in a terminal connected to an end portion of the first electric wire is inserted through by the stud bolt 62*a* and tightened by a nut so that the first electric wire connection portion 62 is electrically connected to the first electric wire.

The plurality of second electric wire connection portions 63 are plate-shaped portions that are exposed forward at the right lower portion on the front side surface of the unit main body 30 and are electrically connected to the plurality of second electric wires (not illustrated). In the present example, the five second electric wire connection portions 63 are disposed side by side in a zigzag manner along the width direction. Example of the second electric wire include an electric wire connected to various electric components mounted on the vehicle. A stud bolt 63*a* is disposed in each second electric wire connection portion 63. The through holes provided in the terminals connected to the end portions of the respective second electric wires are inserted through by the stud bolts 63*a* and tightened with nuts so that each second electric wire connection portion 63 is electrically connected to the corresponding second electric wire.

The first fuse element 64 is a rectangular plate-like portion which is exposed in both front and rear directions at the right side of the first electric wire connection portion 62 on the front side surface of the unit main body 30 and interposed in the middle of an electric circuit connecting the battery connection portion 61 and the first electric wire connection portion 62. The first fuse element 64 includes a fusible portion 64*a* in which a metal having a relatively low melting point compared with other portions other than the fusible portion is disposed.

The fusible portion 64*a* is designed to be fused by Joule heat when an electric current exceeding the rating flows through the first electric wire connected to the first electric wire connection portion 62. When the fusible portion 64*a* is fused, the electrical connection between the battery connection portion 61 and the first electric wire connection portion 62 (first electric wire) is interrupted.

The plurality of second fuse elements 65 are a rectangular plate-like portion which is exposed in both the front and rear directions above the plurality of second electric wire connection portions 63 on the front side surface of the unit main body 30 and interposed in the middle of an electric circuit connecting the battery connection portion 61 and the second electric wire connection portion 63. In the present example, five second fuse elements 65 are disposed in a row side by side along the width direction. Each of the second fuse elements 65 has a fusible portion 65*a* in which a metal having a relatively low melting point compared with the other portions other than the fusible portion is disposed.

Each fusible portion 65*a* is designed to be fused by Joule heat when an electric current exceeding the rating flows through the second electric wire connected to the corresponding second electric wire connection portion 63. When the fusible portion 65*a* is fused, the electrical connection between the battery connection portion 61 and corresponding the second electric wire connection portion 63 (corresponding second electric wire) is interrupted.

As illustrated in FIG. 2 and FIG. 3, the cover 40 and the cover 50 are attached to the housing 70, respectively, so that the cover 40 covers the first fuse element 64 (in particular, fusible portion 64*a*) and the cover 50 covers a plurality of (five in the present example) second fuse elements 65 (in particular, the respective fusible portions 65*a*). By mounting the covers 40 and 50 in this manner, the scattering of the fused matter (molten piece of metal forming the fusible portion) can be prevented when the fusible portions 64*a* and 65*a* are fused.

Hereinafter, the configuration of the cover 40 and the attachment of the cover 40 to the housing 70 will be described.

Figure 4A:
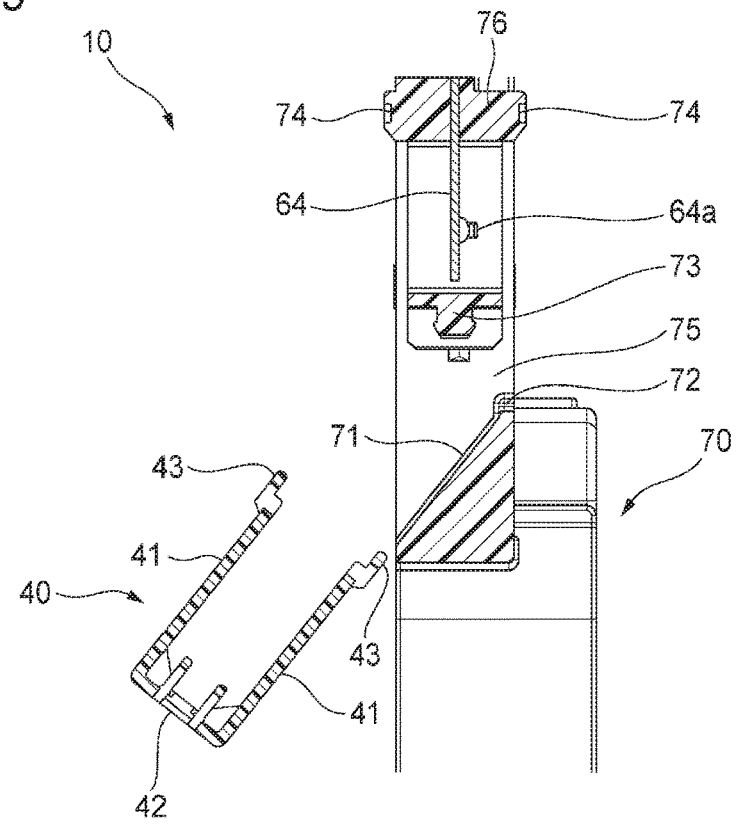
FIGS. 4A and 4B are cross-sectional views taken along A-A line of FIG. 3.

As illustrated in FIG. 4A, the cover 40 includes a pair of side wall portions 41 and a connection portion 42 connecting one end portions of the pair of side wall portions 41 to each other. A pair of locking portions 43 is provided at the tip portions (free end portions) of the pair of side wall portions 41. As described below, in a state in which the attachment of the cover 40 is completed, the pair of locking portions 43 engages with the pair of locking portions 74 of the housing 70. The width (dimension in y-axis direction) of the cover 40 (the pair of side wall portions 41 and connection portion 42) substantially coincides with the width (dimension in y-axis direction) of the first fuse element 64.

As illustrated in FIG. 3 and FIG. 4A, in the housing 70, there is a penetrating portion 75 which penetrates in the front-rear direction (x-axis direction) at the lower side of the first fuse element 64 and the guide wall 71 is provided so as to face the lower end surface of the first fuse element 64 at the lower side of the penetrating portion 75.

The guide wall 71 is inclined so that the wall surface is positioned more forward (x-axis negative direction side) (that is, in a direction intersecting in the vertical direction) as moving downward (z-axis negative direction). A pair of abutment portions 72 projecting upward is provided at both end portions in the width direction (y-axis direction) at the termination end portion (uppermost end portion) of the guide wall 71.

The guide wall 71 functions to guide the cover 40 toward the first fuse element 64 (fusible portion 64*a*) when the cover 40 is attached to the housing 70. Hereinafter, a procedure for attaching the cover 40 to the housing 70 will be described.

Figure 4B:
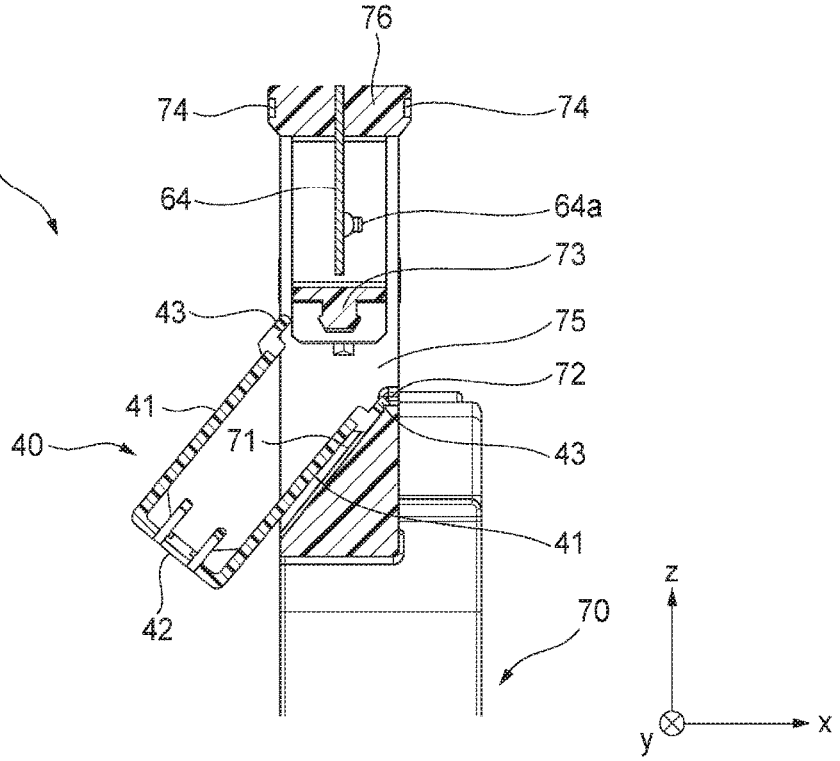

First, as illustrated in FIG. 4A, the tip portion of one side wall portion 41 in the cover 40 is close to the guide wall 71. Next, as illustrated in FIG. 4B, while sliding the outer side surface of one side wall portion 41 on the wall surface of the guide wall 71 (that is, while guiding the cover 40 by guide wall 71), the cover 40 moves obliquely upward along the guide wall 71.

Figure 5A:
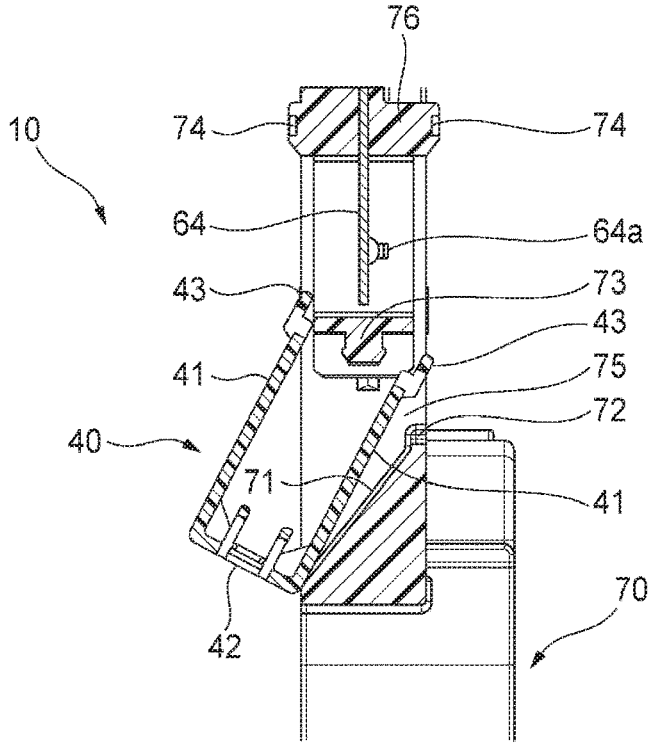
FIG. 5A is a cross-sectional view illustrating a stage in the middle of attaching the cover to a housing.

Next, As illustrated in FIG. 5A, the tip portion of one side wall portion 41 is moved through the penetrating portion 75 to a rear side (x-axis positive direction side) of a first frame body portion 73 (portion constituting upper wall defining penetration portion 75) of the housing 70. At this time, the tip portions of the pair of side wall portions 41 are disposed so that the first frame body portion 73 faces each other with the first frame body portion 73 interposed in the front-rear direction (x-axis direction).

Subsequently, while the inner side surfaces of the pair of side wall portions 41 are slid on the both front and rear surfaces of the first frame body portion 73 (that is, while cover 40 is guided by first frame body portion 73), the cover 40 is further moved upward.

Figure 5B:
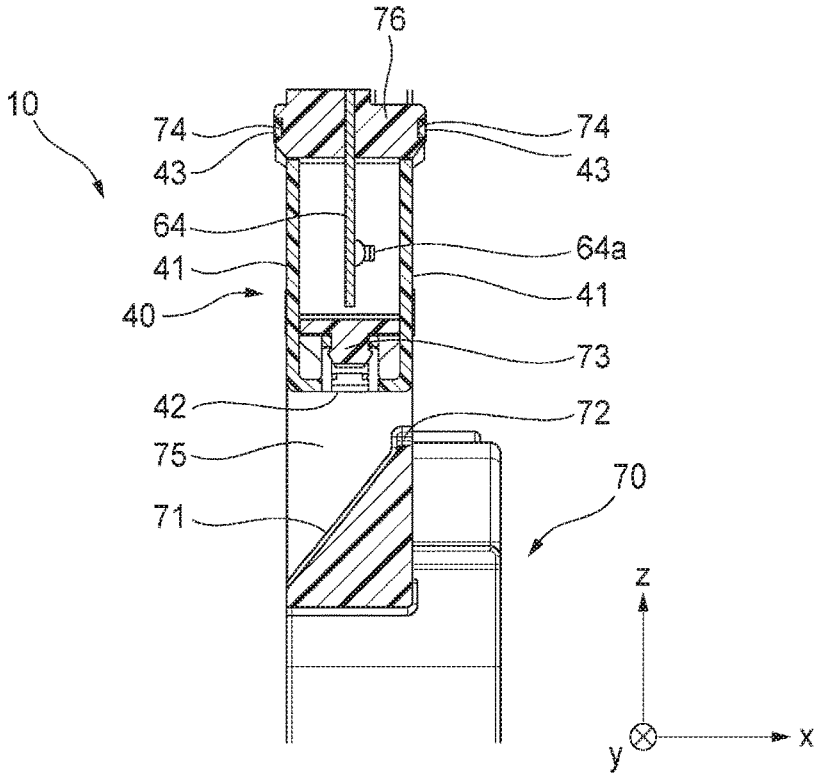
FIG. 5B is a cross-sectional view illustrating a stage in which attachment of the cover to the housing is completed.

When the cover 40 reaches the attachment completion position, as illustrated in FIG. 5B, the pair of locking portions 43 of the cover 40 are respectively engaged with the pair of locking portions 74 provided on both the front and rear surfaces of the second frame body portion 76 (portion which positions on upper side of first fuse element 64) of the housing 70 and thus the attachment of the cover 40 to the housing 70 is completed.

As illustrated in FIG. 5B, in the attachment completion state, the pair of side wall portions 41 of the cover 40 cover the first fuse element 64 (in particular, the fusible portion 64*a*) at both front and rear sides. Accordingly, the scattering of fused matter from scattering can be prevented when the fusible portion 64*a* is fused. In the attachment completion state, unintentional separation (falling off) of the cover 40 from the housing 70 due to gravity or the like is suppressed by the engagement between the pair of locking portions 43 and the pair of locking portions 74. In the attachment completion state, the cover 40 (more specifically, connection portion 42) is separated from the abutment portion 72.

Figure 6:
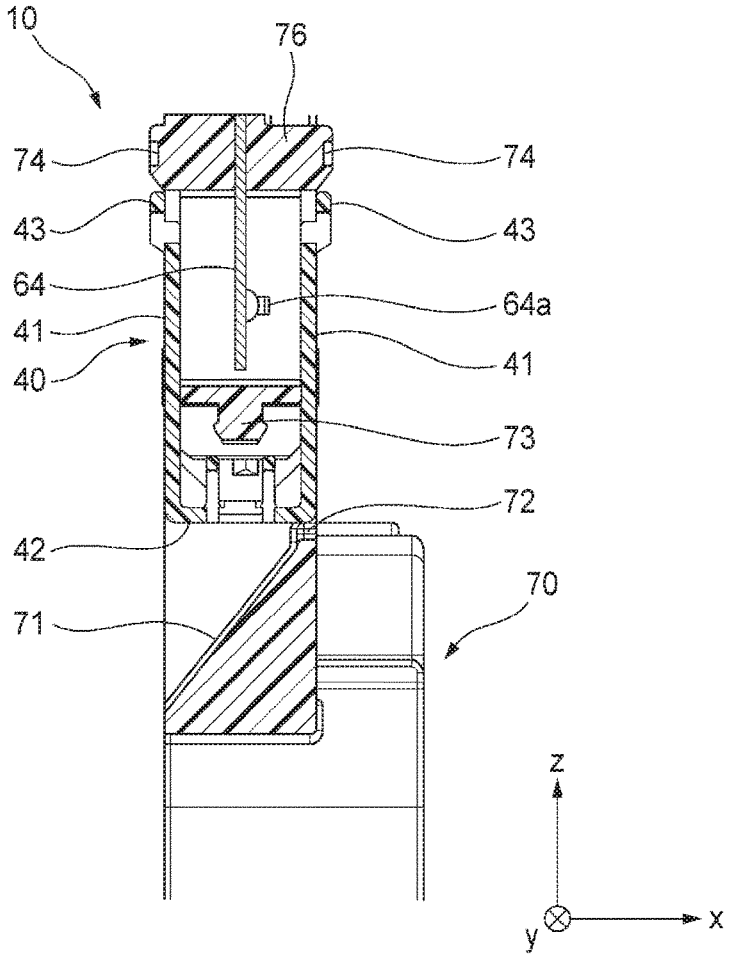
FIG. 6 is a cross-sectional view illustrating a state where the cover is unintentionally separated from the housing and abuts against an abutment portion.

Tentatively, in a case where the engagement between the pair of locking portions 43 and the pair of locking portions 74 is unintentionally released and the cover 40 is moved downward by gravity, as illustrated in FIG. 6, the cover 40 (more specifically, connection portion 42) abuts against the abutment portion 72 and thus the cover 40 is no longer moving downward.

As can be understood from FIG. 6, even in a state where the cover 40 (more specifically, connection portion 42) abuts against the abutment portion 72, the fusible portion 64*a* of the first fuse element 64 is still interposed (covered) between the pair of side wall portions 41 of the cover 40. Therefore, in this state, even if the fusible portion 64*a* is fused, continued scattering of fused matter can be prevented.

As described above, the cover 40 is attached to the housing 70 so as to cover the fusible portion 64*a* from the lower side of the first fuse element 64. On the other hand, the cover 50 is attached to the housing 70 so as to collectively cover a plurality of second fuse elements 65 (a plurality of fusible portions 65*a*) from the right side (right side of unit main body 30) of the plurality of second fuse elements 65.

As illustrated in FIG. 2, the cover 50 also has a pair of side wall portions 51 and a connection portion 52 connecting one end portion of the pair of side wall portions 51 to each other, like the cover 40. A pair of locking portions 53 is provided at the tip portions (free end portions) of the pair of side wall portions 51. In a state where the attachment of the cover 50 is completed, the pair of locking portions 53 is engaged with the pair of locking portions 77 of the housing 70. The width (the dimension in the z-axis direction) of the cover 50 (the pair of side wall portions 51 and the connection portion 52) substantially coincides with the width (dimension in the z-axis direction) of each second fuse element 65.

Furthermore, the entirety of the unit main body 30 to which the cover 40 and the cover 50 are attached is covered with a battery cover (see FIG. 1 and FIG. 2).

As described above, the entirety of the unit main body 30 is covered with a battery cover 80, tentatively the engagement between the pair of locking portions 53 and the pair of locking portions 77 is unintentionally released, the cover 50 is moved to the right side, and thus the cover 50 (more specifically, connection portion 52) abuts on the inner surface of the battery cover 80, so that the falling off of the cover 50 is suppressed.

According to the fuse unit 10 according to the embodiment of the present invention, since the cover 40 is guided by the guide wall 71 when attaching the cover 40 to the housing 70, the positioning of the cover 40 is not insufficient, and the damage of the cover 40 can be prevented.

Further, the guide wall 71 is inclined to a direction intersecting the separation direction (vertical direction) of the cover 40. Therefore, even in a case where the cover 40 is unintentionally separated (fall off) due to gravity or the like, it is suppressed that the cover 40 is guided along the guide wall 71 in the opposite direction to promote separation. As a result, unintentional falling off of the cover 40 can be suppressed.

Furthermore, in a case where the cover 40 is unintentionally separated, since the abutment portion 72 abuts the cover prior to the guide wall 71, it is further reliably prevented that the cover 40 is guided in the opposite direction along the guide wall 71.

In addition, when the cover 40 is abutted against the abutment portion 72, the fusible portion 64*a* of the first fuse element 64 is continuously interposed by the cover 40. Therefore, the scattering of the molten matter is prevented when the fusible portion 64*a* is fused.

The present invention is not limited to the embodiment described above and various modification examples can be adopted within the scope of the present invention. For example, the present invention is not limited to the embodiments described above, but may be appropriately modified, improved, and the like. In addition, the materials, shapes, dimensions, numbers, disposition locations, and the like of the constituent elements in the embodiments described above are arbitrary as far as the present invention can be achieved and are not limited.

For example, in the above embodiment, the abutment portion 72 is provided at a termination end portion (uppermost end portion) of the guide wall 71. However, such an abutment portion may not be provided. Even in this case, since the guide wall 71 is inclined to a direction intersecting the separation direction (vertical direction) of the cover 40, it can be prevented that the cover 40 is guided in the opposite direction along the guide wall 71 to promote separation.

Here, the features of the embodiment of the fuse unit according to the present invention described above are briefly summarized by the following (i) and (ii), respectively.

(i) There is provided a fuse unit (10) including:

a fuse element (64) which includes a fusible portion (64*a*);

a housing (70) which accommodates a fuse element (64) in a state that the fusible portion (64*a*) is exposed to an outside thereof; and a cover (40) which is attached to the housing (70) so as to cover the fusible portion (64*a*), wherein the cover (40) includes a pair of side wall portions (41) which is disposed so as to face each other with the fusible portion (64*a*) interposed therebetween, and a connection portion (42) which connects the pair of side wall portions (41), the housing (70) includes a guide wall (71) which is configured to guide the cover (40) toward the fusible portion (64*a*) when the cover (40) is attached to the housing (70), and the guide wall (71) is inclined to a direction intersecting a separation direction in which the cover (40) is separated from the housing (70).

(ii) In the fuse unit (10) according to the above (i), wherein the housing (70) has an abutment portion (72) which protrudes at a termination end portion of the guide wall (71) in the separation direction, and the fusible portion (64*a*) is interposed between the pair of side wall portions (41) of the cover (40) in a state that the cover (40) and the abutment portion (72) abut against each other.

According to the fuse unit having the configuration of the above (i), when the cover is attached to the housing, the cover is guided by the guide wall. Therefore, there is little possibility that the positioning of the cover becomes insufficient, compared with the unit of the related art. Therefore, the cover can be easily mounted on the housing.

Further, the guide wall is inclined in a direction intersecting the separation direction of the cover. Therefore, tentatively, in a case where the cover is unintentionally separated (fall off), promotion of separation of the cover is suppressed, compared with the case where the guide wall is formed along the separation direction of the cover. Therefore, even in a case where the cover is misaligned, unintentional falling off can be suppressed.

Therefore, in the fuse unit having the configuration described above, the cover is likely to be attached to the housing and unintentional falling off of the cover can be suppressed.

According to the fuse unit having the configuration of the above (ii), in a case where the cover is unintentionally separated, the abutment portion comes in contact with the cover prior to the guide wall. Therefore, it is further reliably prevented that the cover is guided in the opposite direction along the guide wall. Furthermore, even in a case where the cover is misaligned and comes in contact with the abutment portion, the fusible portion of the fuse element is interposed between the side wall portions of the cover. Therefore, even in such a case, the scattering of the molten matter can be prevented when the fusible portion is fused.

According to the present invention, it is possible to provide a fuse unit in which the cover can be likely to be attached to the housing and the unintentional falling off of the cover can be suppressed.

What is claimed is:

1. A fuse unit comprising:

a fuse element which includes a fusible portion;

a housing which accommodates the fuse element in a state that the fusible portion is exposed to an outside thereof; and a cover which is attached to the housing so as to cover the fusible portion, wherein the cover includes a pair of side wall portions which is disposed so as to face each other with the fusible portion interposed therebetween, and a connection portion which connects the pair of side wall portions, the housing includes a guide wall, the guide wall guiding the cover toward the fusible portion by contacting an outer surface of the cover when the cover is being attached to the housing, the guide wall is inclined with respect to a separation direction in which the cover is separated from the housing, and the housing includes an abutment portion which upwardly protrudes from a termination end portion of the guide wall in the separation direction.

2. The fuse unit according to claim 1, wherein:

the fusible portion is interposed between the pair of side wall portions of the cover in a state that the cover and the abutment portion abut against each other.

3. A fuse unit comprising:

a fuse element which includes a fusible portion;

a housing which accommodates the fuse element in a state that the fusible portion is exposed to an outside thereof; and a cover which is attached to the housing so as to cover the fusible portion, wherein the cover includes a pair of side wall portions which is disposed so as to face each other with the fusible portion interposed therebetween, and a connection portion which connects the pair of side wall portions, the housing includes a guide wall, the guide wall guiding the cover toward the fusible portion by contacting an outer surface of the cover when the cover is being attached to the housing, the guide wall is inclined with respect to a separation direction in which the cover is separated from the housing, the housing includes an abutment portion which protrudes at a termination end portion of the guide wall in the separation direction, and wherein the fuse element overlaps the inclined guide wall in the separation direction.

4. The fuse unit according to claim 1, wherein at least a part of each of the side wall portions of the cover overlap the fusible portion in a direction perpendicular to the separation direction, and wherein at least a part of each of the side wall portions are substantially parallel to one another.

5. The fuse unit according to claim 1, wherein the pair of side wall portions are disposed between the housing and the fusible portion in a direction perpendicular to the separation direction.

* * * * *